United States Patent [19]

Garner

[11] 4,238,253

[45] Dec. 9, 1980

[54] STARCH AS FUEL IN GAS GENERATING COMPOSITIONS

[75] Inventor: Eugene F. Garner, Canyon Country, Calif.

[73] Assignee: Allied Chemical Corporation, Morris Township, Morris County, N.J.

[21] Appl. No.: 905,829

[22] Filed: May 15, 1978

[51] Int. Cl.[2] ..... C06B 45/10

[52] U.S. Cl. ..... 149/19.6; 149/19.91; 149/82; 149/83; 149/85

[58] Field of Search ..... 149/19.6, 19.91, 82, 149/83, 85

[56] References Cited

U.S. PATENT DOCUMENTS

| | | | |
|---|---|---|---|
| 3,052,577 | 9/1962 | Butler et al. | 149/82 |
| 3,837,942 | 9/1974 | Catanzante | 149/83 |
| 3,862,866 | 1/1975 | Timmerman et al. | 149/21 |
| 3,912,562 | 10/1975 | Garner | 149/82 |
| 4,128,996 | 12/1978 | Garner et al. | 149/83 |

*Primary Examiner*—Edward A. Miller

*Attorney, Agent, or Firm*—Roger H. Criss

[57] ABSTRACT

Starch is used as a fuel/binder in pyrotechnic propellant compositions suitable for use in vehicle safety restraint systems.

7 Claims, No Drawings

STARCH AS FUEL IN GAS GENERATING COMPOSITIONS

BACKGROUND OF THE INVENTION

1. Field of the Invention

This invention relates to the use of starch as a fuel/-binder in pyrotechnic compositions, especially those propellants suitable for use in inflating an infltable device, such as a vehicle safety restraint.

2. Description of the Prior Art

Various pyrotechnic propellants have been prepared for generating a gas upon combustion in order to inflate an air bag or similar safety restraint in a vehicle so as to restrain movement of an occupant in the event of a sudden deceleration of the vehicle, such as caused by a collision. In order to be employed as a pyrotechnic gas generating composition for inflatable occupant restraints, several criteria must be met. The pyrotechnic must be capable of producing non-toxic, non-flammable and essentially smokeless gases over a wide variety of temperatures and other environmental conditions. The gases that are generated must be totally ignited at a sufficiently low temperature so as not to destroy the restraint or injure the occupant. The pyrotechnic must also be safe to handle and must be capable of generating a substantial amount of gas within a very short period of time, e.g., less than about 100 milliseconds.

A wide variety of pyrotechnic compositions have been suggested for possible use for inflating vehicle occupant safety restraints. A typical pyrotechnic composition is disclosed in U.S. Pat. No. 3,897,285 to Hamilton et al., and is comprised of a fuel such as carbonaceous material, aluminum or magnesium; and an inorganic oxidizer such as metal chlorate, a metal perchlorate, or a metal nitrate.

Another typical pyrotechnic composition is described in co-pending application Ser. No. 767,726, filed Feb. 11, 1977 and incorporated herein by reference. The pyrotechnic composition disclosed therein is comprised of an inorganic oxidizer such as a metal perchlorate and a highly oxygenated organic binder such as a polyester resin or polyacetal resin.

Although pyrotechnic compositions can be produced using a wide variety of ingredients, to obtain a wide variety of results, there is still a need to develop a fuel/-binder which can offer both economic advantages as well as pyrotechnic advantages, such as higher burn rates at lower energy levels.

SUMMARY OF THE INVENTION

In accordance with the present invention, starch is provided as a fuel/binder for use in pyrotechnic compositions wherein the compositions are comprised of about 0 to 5 wt. %, preferably about 1 to 2 wt. % binder such as polyvinyl acetate; about 30 to 95 wt. %, preferably 45 to 50 wt. % inorganic oxidizer, about 2 to 20 wt. %, preferably 8 to 13 wt. % starch, about 0 to 50 wt. %, preferably about 35 to 45 wt. % coolant such as calcium hydroxide; and about 0 to 1 wt. %, preferably about 0.4 to 0.6 wt. % carbon black.

The use of starch in such compositions increases the burn rate over other conventionally used fuel/binders at any given energy level. Starch is also more economical to use than other more exotic fuel/binders.

DETAILED DESCRIPTION

Pyrotechnic compositions for which the presently claimed binder is suitable for use are generally any of those pyrotechnic compositions containing an oxidizer known in the art. Such pyrotechnic compositions generate a gas upon combustion and are generally comprised of mixtures of chemical components such as fuels, oxidizers, coolants, opacifiers, and other propellant adjuvants. These compositions are capable of being activated by, for example, an electrically energized squib to generate substantial volumes of gas for inflating such devices as automobile crash bags.

Oxidizing compounds suitable for use in pyrotechnic compositions include metal peroxides such as sodium peroxide, potassium peroxide, rubidium peroxide, cesium peroxide, calcium peroxide, strontium peroxide, and varium peroxide; inorganic chlorate such as sodium chlorate, potassium chlorate, lithium chlorate, rubidium chlorate, magnesium chlorate, strontium chlorate, barium chlorate; inorganic perchlorate such as lithium perchlorate, sodium perchlorate, potassium perchlorate, rubidium perchlorate, magnesium perchlorate, calcium perchlorate, strontium perchlorate, barium perchlorate, ferric perchlorate, and cobalt perchlorate; and metal nitrates such as lithium nitrate, sodium nitrate, potassium nitrate, copper nitrate, silver nitrate, magnesium nitrate, barium nitrate, zinc nitrate, aluminum nitrate, thallium nitrate, stannic nitrate, bismuth nitrate, manganese nitrate, ferric nitrate, ferrous nitrate and nickel nitrate. Also suitable for use are ammonium chlorate, ammonium perchlorate, ammonium nitrate, and the like.

It is also within the scope of the present invention that a coolant such as calcium hydroxide, magnesium chloride, calcium carbonate, or magnesium carbonate, as well as opacifiers such as carbon black can be incorporated into the presently claimed compositions.

Starch suitable for use in the present invention can be any of the conventionally known high-polymeric carbohydrates such as corn starch, wheat starch, potato starch, rice starch, tapioca starch, arrowroot starch, etc. When used in the pyrotechnic compositions herein, the starch should be of a particle size of about 4 to 30$\mu$. These small particle sizes can be acquired by any conventional grinding means such as ball-milling.

Although the starch can be used as the sole binder in the pyrotechnic compositions of the present invention it is preferred to also use up to about 5 wt. % of a traditional binder such as the oxygen-containing polymeric compounds. Non-limiting examples of such compounds include polyacetal resins including both homopolymer and copolymers, polyvinyl acetate resins, polyesters, polyurethanes, polyester & polyurethane copolymers, polycarbonates and polymers based on cellulose compounds such as cellulose acetate, and the like. Preferred are the polyacetal resins and polyvinyl acetate, more preferred is polyvinyl acetate.

The method of preparing the pyrotechnic compositions of the present invention is not critical. One preferred method is to intimately mix the ingredients by ball-milling under an appropriate solvent such as methylene chloride. The admixture is then dried and pressed into pellets.

The pyrotechnic compositions of this invention may be employed with any suitable gas generator apparatus for use in inflating a variety of inflatable devices, preferably vehicle occupant restraint devices, such as air bags.

In order to further describe the present invention, the following non-limiting examples are given.

EXAMPLE I

A composition consisting of 0.5 wt. % carbon black, 2 wt. % polyvinyl acetate, 7 wt. % corn starch, 48.5 wt. % sodium chlorate and 42 wt. % calcium hydroxide was intimately mixed under methylene chloride, dried, and pressed into pellets. The aforementioned weight percents are based on the total weight of the composition.

The pellets were pressed into a slug measuring about 2 inches long and 1 inch in diameter. The slug was inserted into a cylindrical steel casing and the exposed end of the slug, to which a nozzle was attached, was ignited. A burn rate of 0.78 inches per second at 1000 psi was measured. This rate is acceptable for safety restraint pyrotechnic compositions wherein any rate over about 0.5 inches per second is generally acceptable.

COMPARATIVE EXAMPLE

A composition consisting of 0.5 wt. % carbon black, 9 wt. % polyvinyl acetate 48.5 wt. % sodium chlorate, and 42 wt. % calcium hydroxide was intimately mixed under methylene chloride, dried, and pressed into pellets. All weight percents are based on the total weight of the composition.

The pellets were pressed into a slug and the burn rate measured as in Example I. The burn rate was found to be 0.5 inches per second at 1000 psi.

It is to be understood that variations and modifications of the present invention may be made without departing from the scope thereof. It is also understood that the present invention is not to be limited by the specific embodiments disclosed herein but only in accordance with the appended claims when read in light of the foregoing specifications.

What is claimed is:

1. A pyrotechnic composition for use in providing a generating gas to inflate an inflatable device, said composition comrpising:

(a) about 45 l to 50 weight percent of an inorganic oxidizer;

(b) about 8 to 13 weight percent of starch having a particle size of about 4 to 30 microns;

(c) about 35 to 45 weight percent of a coolant selected from the group consisting of calcium hydroxide, magnesium chloride, calcium carbonate and magnesium carbonate;

(d) about 1 to 2 weight percent of an oxygen-containing polymeric compound selected from the group consisting of polyacetal resins and polyvinyl acetate resins; and (e) about 0 to 1 weight percent of carbon black.

2. The composition of claim 1 wherein the inorganic oxidizer is selected from the group consisting of sodium chlorate, potassium chlorate, sodium perchlorate, and potassium perchlorate.

3. The composition of claim 2 wherein the starch is corn starch.

4. The composition of claim 1 wherein the inorganic oxidizer is sodium chlorate.

5. The composition of claim 4 wherein the coolant is calcium hydroxide.

6. The composition of claim 5 wherein the oxygen-containing polymeric compound is polyvinyl acetate.

7. The composition of claim 1 wherein said carbon black is present in an amount of about 0.4 to 0.6 weight percent.

* * * * *

UNITED STATES PATENT AND TRADEMARK OFFICE

CERTIFICATE OF CORRECTION

PATENT NO. : 4,238,253

DATED : December 9, 1980

INVENTOR(S) : Eugene F. Garner

It is certified that error appears in the above-identified patent and that said Letters Patent are hereby corrected as shown below:

Column 1, line 8, following "fuel/" omit " - ";

line 10, change "infltable" to -- inflatable --;

line 48, following "fuel/" omit " - ";

line 61, following "starch" omit " , " and insert therefor -- ; --.

Column 3, line 23, following "acetate" insert -- , --.

Column 4, line 6, change "comrpising" to -- comprising --;

line 7, following "45" omit "1".

Signed and Sealed this

*Thirty-first* Day of *March 1981*

[SEAL]

*Attest:*

RENE D. TEGTMEYER

*Attesting Officer*

*Acting Commissioner of Patents and Trademarks*